US008492986B2

(12) United States Patent
Radermacher

(10) Patent No.: US 8,492,986 B2
(45) Date of Patent: Jul. 23, 2013

(54) LED CIRCUIT ARRANGEMENT WITH IMPROVED FLICKER PERFORMANCE

(75) Inventor: Harald J. G. Radermacher, Aachen (DE)

(73) Assignee: Koninklijke Philips N.V., Eindhoven (NL)

( * ) Notice: Subject to any disclaimer, the term of this patent is extended or adjusted under 35 U.S.C. 154(b) by 306 days.

(21) Appl. No.: 13/121,427

(22) PCT Filed: Sep. 29, 2009

(86) PCT No.: PCT/IB2009/054254

§ 371 (c)(1),
(2), (4) Date: Mar. 29, 2011

(87) PCT Pub. No.: WO2010/038190

PCT Pub. Date: Apr. 8, 2010

(65) Prior Publication Data

US 2011/0187279 A1 Aug. 4, 2011

(30) Foreign Application Priority Data

Oct. 2, 2008 (EP) ..... 08165696

(51) Int. Cl.
*H05B 37/00* (2006.01)

(52) U.S. Cl.
USPC ..... 315/227 R; 315/251; 315/32

(58) Field of Classification Search
USPC ..... 315/32, 185 R, 187, 192, 210, 227 R, 315/251, 291, 194; 362/551, 800
See application file for complete search history.

(56) References Cited

U.S. PATENT DOCUMENTS

| | | | | |
|---|---|---|---|---|
| 6,323,598 | B1 | 11/2001 | Guthrie et al. | |
| 7,791,285 | B2 * | 9/2010 | Wu | 315/227 R |
| 8,035,313 | B2 * | 10/2011 | Wendt et al. | 315/291 |
| 8,084,945 | B2 * | 12/2011 | Deppe et al. | 315/32 |
| 8,106,599 | B2 * | 1/2012 | Radermacher et al. | 315/291 |
| 8,148,905 | B2 * | 4/2012 | Miskin et al. | 315/185 R |
| 2010/0237800 | A1 * | 9/2010 | Kang et al. | 315/294 |

FOREIGN PATENT DOCUMENTS

| | | | |
|---|---|---|---|
| EP | 0695112 | A1 | 1/1996 |
| WO | 2005120134 | A1 | 12/2005 |

* cited by examiner

*Primary Examiner* — Vibol Tan
(74) *Attorney, Agent, or Firm* — Mark L. Beloborodov

(57) ABSTRACT

A circuit arrangement (1) for a light emitting device, comprising a first circuit branch (2) for receiving an AC voltage and comprising a first light emitting diode (LED) circuit (3) serially connected with a first phase-shifting element (4), a second circuit branch (12) connected in parallel with the first circuit branch, the second circuit branch comprising a second LED circuit (13) serially connected to a second phase-shifting element (14), in reverse order compared with the LED circuit and phase-shifting element in the first circuit branch, and a third circuit branch (22) comprising a third LED circuit (23) connected between the first and second branches.
With such a circuit design, the current through the first and second LED can be phase shifted compared with the current though the third LED circuit, so that the first and second light emitting diode circuits emit light during one time period, while the third light emitting diode circuit emits light during a second period.

10 Claims, 6 Drawing Sheets

LED CIRCUIT ARRANGEMENT WITH IMPROVED FLICKER PERFORMANCE

FIELD OF THE INVENTION

The present invention relates to a LED circuit arrangement adapted for AC drive with improved flicker performance.

BACKGROUND OF THE INVENTION

For low cost general illumination applications of white LEDs, the usage of high-voltage LED strings for AC operation is quite advantageous. These LED modules can be designed to have a dedicated operating voltage, which allows the use of resistive ballasts to connect them to the mains supply voltage. The ballast resistor is very cheap compared to usual driver circuits, which require e.g. power semiconductors, magnetic components, control electronics, etc. Due to its simplicity, it can be expected to be very reliable. An adaptation to high operation temperatures is quite straightforward.

A current will only flow through the LEDs when the voltage exceeds the forwards voltage of the LEDs, and as a result there will be periods of no light output around each voltage crossover. The LEDs will thus provide a pulsating light, having a frequency determined by the mains frequency. The pulsation frequency will be 100 Hz or 120 Hz, based on the usage in a 50 Hz or 60 Hz grid (e.g. Europe or USA).

This pulsation is sufficiently fast that it will not immediately lead to flickering effects when looking at/into the light source or its reflection from an object illuminated by the light source. However, as soon as motion occurs (either of the source, an illuminated object, or the eye), a stroboscopic effect is created.

Document WO 2005/120134 discloses a circuit comprising two parallel circuit branches, each comprising a pair of anti-parallel connected light emitting diodes. The first branch further comprises a capacitor and the second branch further comprises a coil. As a result, the currents in the two branches are phase-shifted and the emitted light changes of the anti-parallel light emitting diode pairs take place at different points in time, and, compared to individual flicker indices of the anti-parallel light emitting diode pairs, an overall flicker index of the circuit is reduced.

SUMMARY OF THE INVENTION

An object of the present invention is to overcome this problem, and to provide an improved circuit arrangement for light emitting diodes with improved flicker performance.

According to an aspect of the invention, this object is achieved by a circuit arrangement for a light emitting device, comprising a first circuit branch for receiving an AC voltage and comprising a first light emitting diode (LED) circuit serially connected with a first phase-shifting element, a second circuit branch connected in parallel with the first circuit branch, the second circuit branch comprising a second LED circuit serially connected to a second phase-shifting element, in reverse order compared to the LED circuit and phase-shifting element in the first circuit branch, and a third circuit branch comprising a third LED circuit, the third circuit branch having one end connected to a point in the first circuit branch between the first LED circuit and the first phase-shifting element, and a second end connected to a point in the second circuit branch between the second LED circuit and the second phase-shifting element.

With such a circuit design, the current through the first and second LED can be phase shifted compared to the current though the third LED circuit, so that the first and second light emitting diode circuits emit light during one time period, while the third light emitting diode circuit emits light during a second period. By selecting suitable phase-shifting elements, these periods can overlap in time, resulting in no dark periods. Some intensity fluctuations may still be present, but there will be a continuous light flux, i.e. there is no point in time where no light is produced. Hence, moving objects will be shown with continuous path rather than a series of flashes.

A flicker index may be defined as a relationship between the light flux with intensity above average and total light flux. Depending on the design of the circuit, flicker indexes as low as 5.2% have been found during the simulations. Better flicker indexes might be possible when using different parameters or components (i.e. select a different scale). This is a significant improvement compared to the 48% of flicker of a conventional configuration, without phase-shifting elements.

It is noted that this is not the only relevant measurement of flicker. Another factor, which may be highly relevant in this context, is the occurrence of periods with no emitted flux (dark periods). As mentioned above, the present invention is advantageous in that it may be designed to completely avoid dark periods.

In addition, the ballast efficiency can be improved compared to the usual 75-78%. Depending on the selection of component value, efficiencies of up to 85% have been found during the simulations. Better efficiencies might be possible when using different parameters or components (i.e. other LEDs).

Yet another advantage of the present invention is that the current through the first and second LED circuits has a reduced third harmonic compared to the mains voltage. A reduction of the third harmonic of the total current supplied by an AC voltage source is advantageous for compliance with mains harmonics regulations.

A light emitting diode circuit comprises one or more inorganic light emitting diodes, organic light emitting diodes (e.g. polymer light emitting diodes), and/or laser light emitting diodes.

The phase-shifting elements may be formed by capacitors. Using a capacitor for phase-shifting a current is advantageous compared with using a coil owing to the fact that the capacitor can be smaller in size for the relevant operation frequency range.

Further, according to this embodiment of the present invention, the first and second light emitting diode circuits are driven with an essentially capacitive current. However, the third light emitting diode circuit, which is connected across the voltage drop of the first and second light emitting diode circuits, is driven with a current that has a phase shift similar to an inductive current. Hence, the current through the first and second light emitting diode circuits is leading in time while the current through the third, intermediate light emitting diode circuit is lagging in time. In other words, an effect similar to that in WO 2005/120134 is achieved without any inductive elements.

According to one embodiment, each light emitting diode circuit is capable of generating light in response to at least a part of a positive half of the AC voltage as well as in response to at least a part of a negative half of the AC voltage. Such a light emitting diode circuit is preferably to be used when being fed with an AC voltage.

An example of such a light emitting diode circuit comprises two anti-parallel strings of one or more serially connected light emitting diodes. Another example comprises a rectifier coupled in series with a string of one or more serially connected light emitting diodes.

It is noted that the invention relates to all possible combinations of features recited in the claims.

BRIEF DESCRIPTION OF THE DRAWINGS

This and other aspects of the present invention will now be described in more detail, with reference to the appended drawings showing a currently preferred embodiment of the invention.

DETAILED DESCRIPTION

Figure 1:
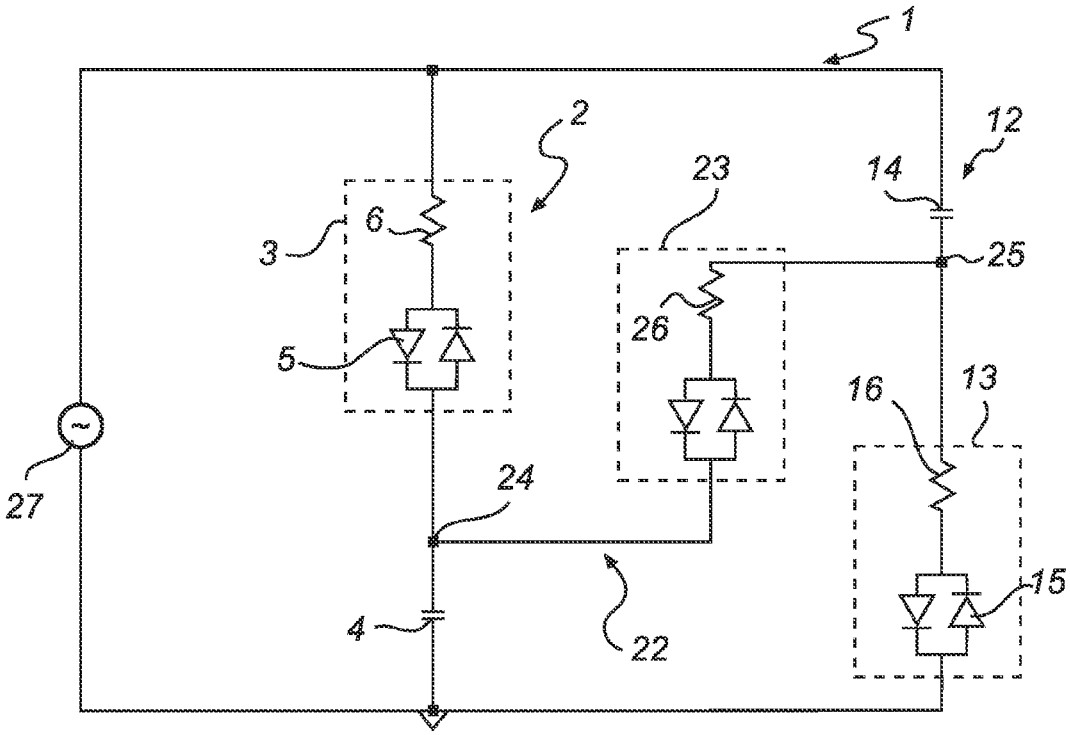
FIG. 1 is a schematic circuit diagram of a first embodiment of the present invention.

A circuit 1 according to an embodiment of the present invention is shown in FIG. 1.

A first circuit branch 2 comprises a first LED circuit 3 and a first phase-shifting element 4, here a capacitor. The LED circuit 3 here comprises at least two LEDs 5 connected in parallel with reversed polarity (anti-parallel) and a ballast resistor 6 connected in series with these LEDs. A second circuit branch 12 comprises a second LED circuit 13 (LEDs 15 and ballast resistor 16) and a second phase-shifting element 14, e.g. a second capacitor. The second branch 12 is connected in parallel with the first branch 2, in such a way that the capacitors 4, 14 and LED circuits 3, 13 are in reverse order. In other words, following the branches from one of their mutual junctions to the other, one branch will have the capacitor before the LED circuit, while the other branch will have the LED circuit before the capacitor.

A third branch 22, comprising a third LED circuit 23 (LEDs and ballast resistor 26), is connected between the two branches 2, 12, between a point 24 between the first LED circuit 3 and the first capacitor 4, and a point 25 between the second LED circuit 13 and the second capacitor 14. In the illustrated case, where the LED circuits 3, 13 include external ballast resistors 6, 16, each respective resistor 6, 16 should be on the same side of the connection point 24, 25 as the LEDs 5, 15 themselves.

An AC voltage source 27 is connected in parallel to the first and second branches, and arranged to drive the circuit.

According to one embodiment, each LED circuit 3, 13, 23 is a so-called ACLED package, comprising several LEDs connected in anti-parallel and adapted for operation directly from mains voltage. As an example, shown in FIG. 2, a package 31 can consist of four serially connected pairs of anti-parallel high voltage LEDs 32. Each LED pair has a ballast resistor 33. The package has two terminals 34 for connection to an AC voltage.

A typical ACLED package designed for 110V operation can have the following parameters:

| Parameter | Value |
|---|---|
| Threshold voltage | 95 V |
| Internal Resistance | 450 ohms |
| Required External Ballast Resistor | 575 ohms |

Of course, it would be possible to integrate the external ballast resistor 6, 16, 26 into the ACLED by modifying the internal resistance. Then only the capacitors 4, 14 are required as external components.

In order to further improve the smoothness of the resulting total flux, and thus the flicker index, the power of the first and second LED circuits can be reduced compared to the third, intermediate LED circuit. Such down-sizing, or scaling, is motivated by the fact that the first and second LED circuits will emit light simultaneously during one period, while only the third LED circuit will emit light during a second period. As a practical realization, this might correspond to having a different number of individual LED connected in series per string. Then with the same drive current less power is consumed, and hence less light is produced.

Figure 3:
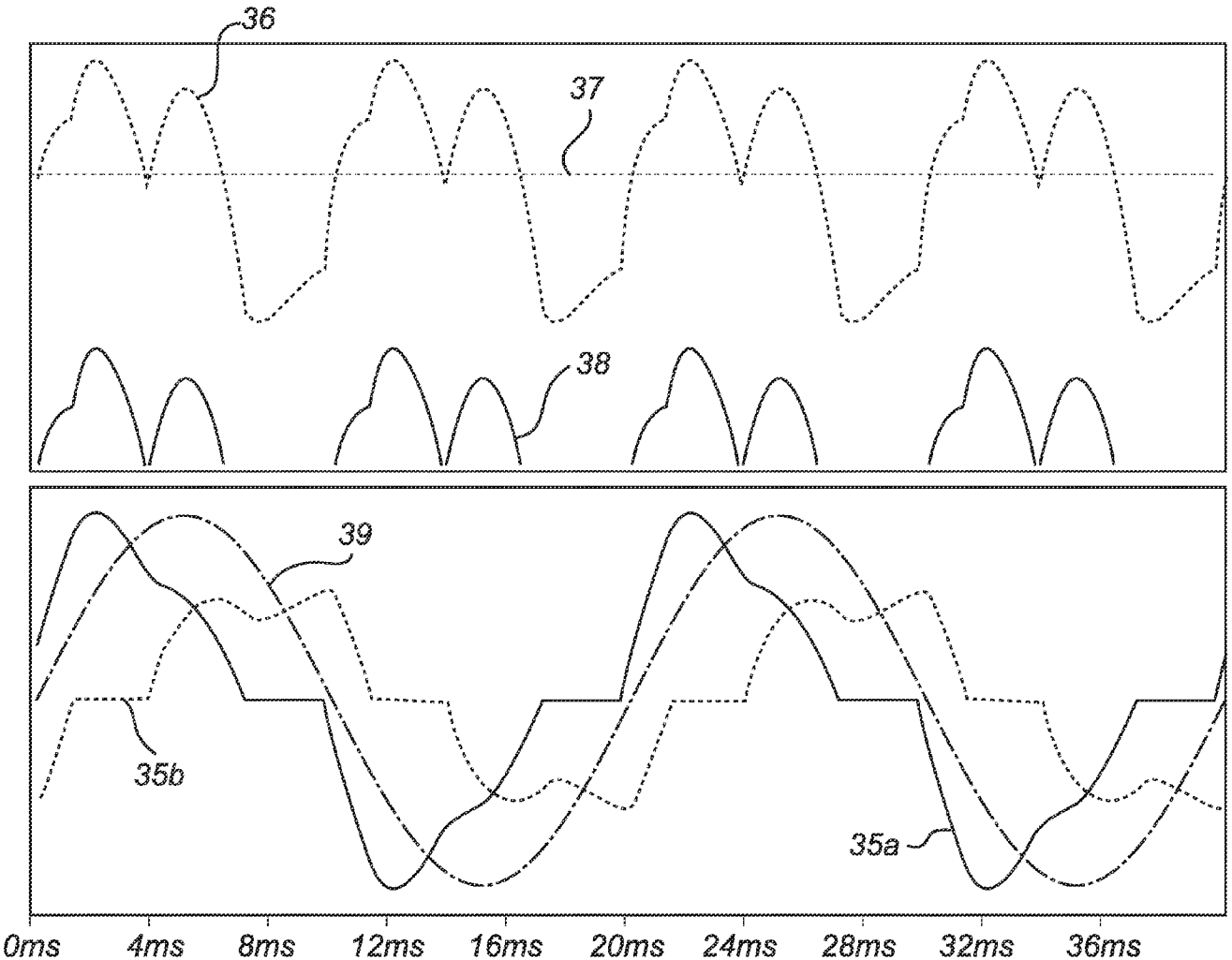
FIG. 3 is a diagram showing flux and current waveforms in the circuit in FIG. 1.

FIG. 3 shows current 35*a*, 35*b* (bottom) and flux 36 (top) waveforms resulting from a simulation of the circuit in FIG. 1, using 1100 nF capacitors, an ACLED with the above specification as the third LED circuit 23, and a scaling factor of 0.6. The flux diagram also shows average flux 37, and a separate waveform 38 indicating flux above average. This can be seen as an illustration of the flicker index, as will be discussed below. In this example, the current 35*a* in the first and second LED circuit 3, 13 is leading a mains voltage 39 by approximately 30° while the current 35*b* in the third LED circuit 23 is lagging by approximately 40°.

Figure 4A:
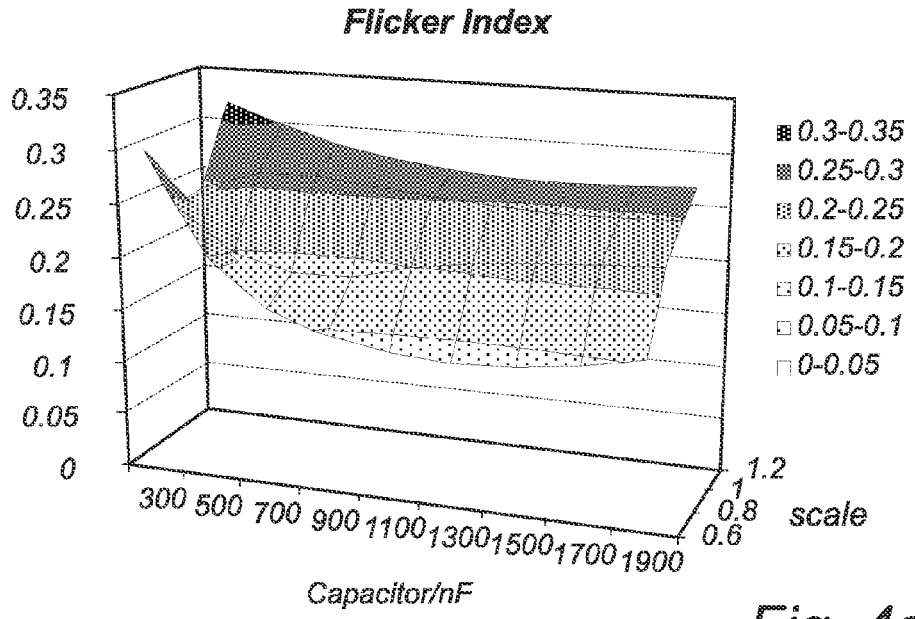
FIG. 4*a* is diagram showing flicker index versus capacitance and scaling factor.

FIG. 4*a* shows the flicker index for various operation points. The flicker index has been determined according to the calculation method of the IESNA, and is defined as the integrated flux above average flux divided by total integrated flux.

For this chart, the value of the capacitor was varied, as well as the relative forward voltage and resistance of the first and second LED circuits (i.e. scaling). Some combinations have a low flicker index, as low as 13%. The normal ACLED would have a flicker index of 0.48, and hence this embodiment of the present invention provides an improvement by a factor of almost 4.

Figure 4B:
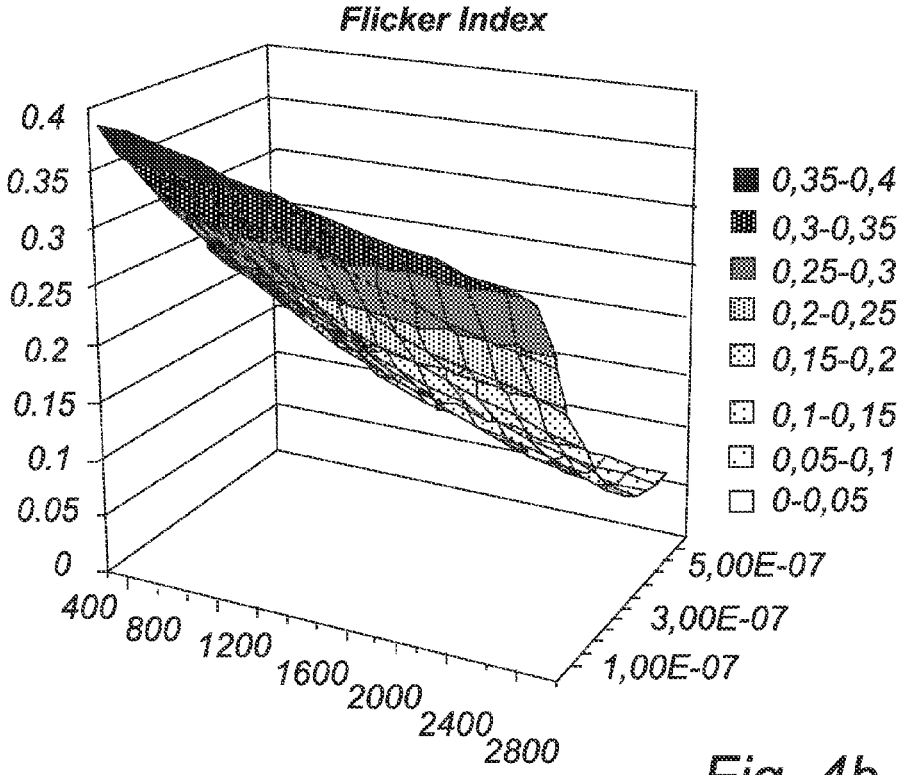
FIG. 4*b* is diagram showing flicker index versus capacitance and resistance value.

FIG. 4*b* shows the flicker index for various operation points within a different parameter range. For this chart, the value of the capacitor was varied, as well as the ballast resistors in the first and second LED circuit while keeping the scale to a fixed value of 0.5 and having no additional ballast resistor in the third LED circuit. Some combinations have an even lower flicker index compared with FIG. 4*a*, as low as 5.2%.

Figure 5:
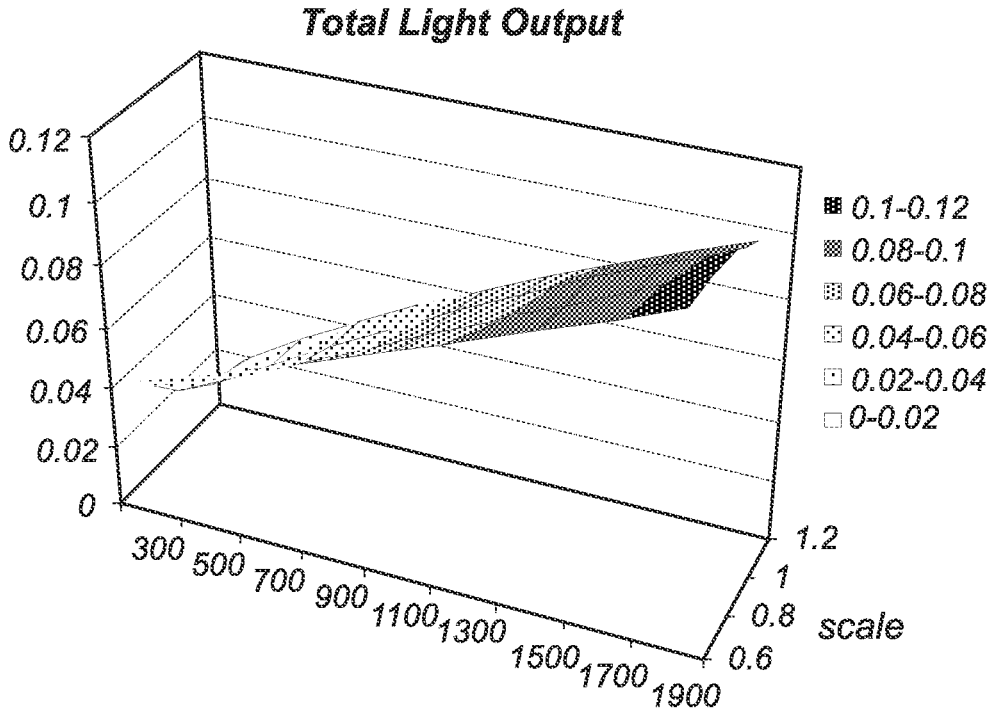
FIG. 5 is diagram showing relative light flux versus capacitance and scaling factor.

The choice of capacitance and scaling factor also influences the total light output, as shown in FIG. 5. Generally, the scaling of the first and second LED circuits has a minor impact on the total flux, and hence this parameter can be selected according to the desired flicker index. The suitable capacitance value can then be selected by the desired flux and the allowed volume for the capacitors.

The choice of capacitance and scaling factor will also influence the efficiency of the total circuit, defined as the ratio between the electrical power delivered to the LED and the total power consumption. For the operation point with 1100 nF and a scale factor of 0.6 (resulting in the lowest flicker index for the selected parameter range) the efficiency is 78%, which is a typical conventional value. The power dissipation is quite equally balanced between the LED circuits. The first and second LED circuits receive an input power of 2.9 W, each, and the third LED circuit receives 3.2 W.

If the ballast resistor 26 of the third LED circuit 23 is omitted, the efficiency is increased to 85%. As a drawback, the flicker index is then slightly increased to 14.7% and the losses are no longer as balanced (3.1 W for each of the first and second LED circuits, 4.04 W for the third LED). However, it may be possible for the skilled person to find an even better operation point with improved efficiency, balanced load and improved flicker. Some possible operation points with improved flicker performance are already shown in FIG. 4*b*.

Figure 6:
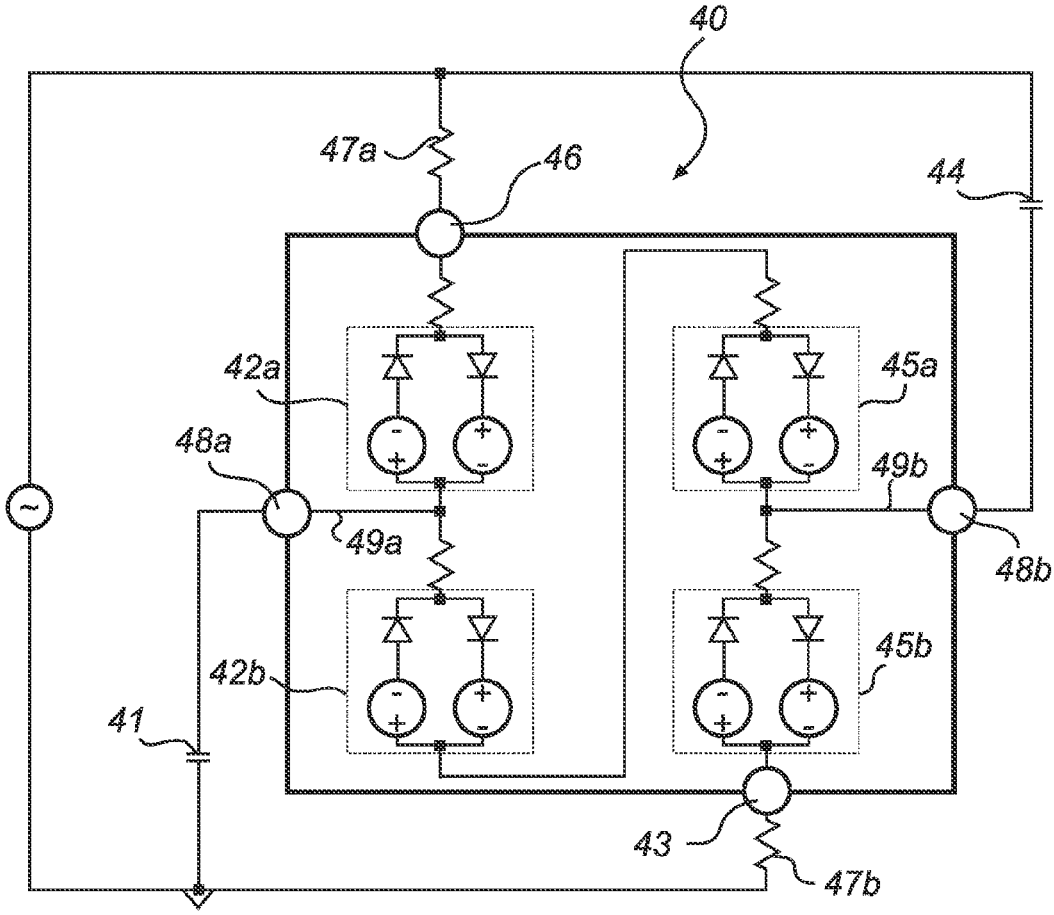
FIG. 6 is a schematic circuit diagram of a second embodiment of the present invention.

In an alternative embodiment, shown in FIG. 6, only one ACLED package 40 is used for all LED circuits. One terminal of a first phase-shifting element 41 (here a capacitor) is connected between the first two pairs of LEDs 42*a*, 42*b*, and the other terminal is connected to one of the terminals 43 of the ACLED. In the same way, a second phase-shifting element 44 (again, here a capacitor) is connected between the last two pairs of LEDs 45*a*, 45*b*, and to the second terminal 46. Thereby, a first branch is formed by the first LED pair 42*a* and the first capacitor 41, a second branch is formed by the fourth LED pair 45*b* and the second capacitor 44, while the third branch is formed by the second and third LED pairs 42*b*, 45*a*. In the illustrated case, additional ballast resistors 47*a*, 47*b* are also provided in the first and second branches.

Figure 7:
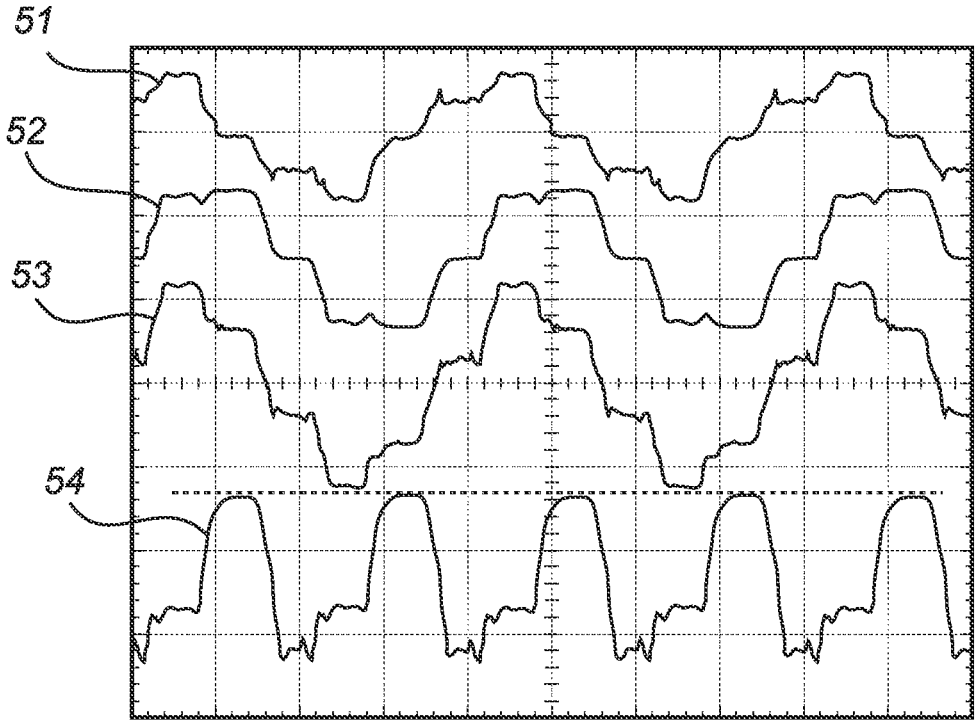
FIG. 7 is a diagram showing flux and current waveforms in the circuit in FIG. 6.

As the third branch has twice as many LED pairs (two) as the first and second branches (one), the circuit has a scaling factor of 0.5, if we assume that the same LED type is used in all LED pairs. Choosing a capacitance of 370 nF, the resulting flicker index is 23%, and the ballast efficiency 77%. FIG. 7 shows current waveforms 51, 52 for LED pair 42*a* and 42*b* respectively, a total mains current 53, and a total light flux waveform 54 for an actual test circuit.

Figure 2:
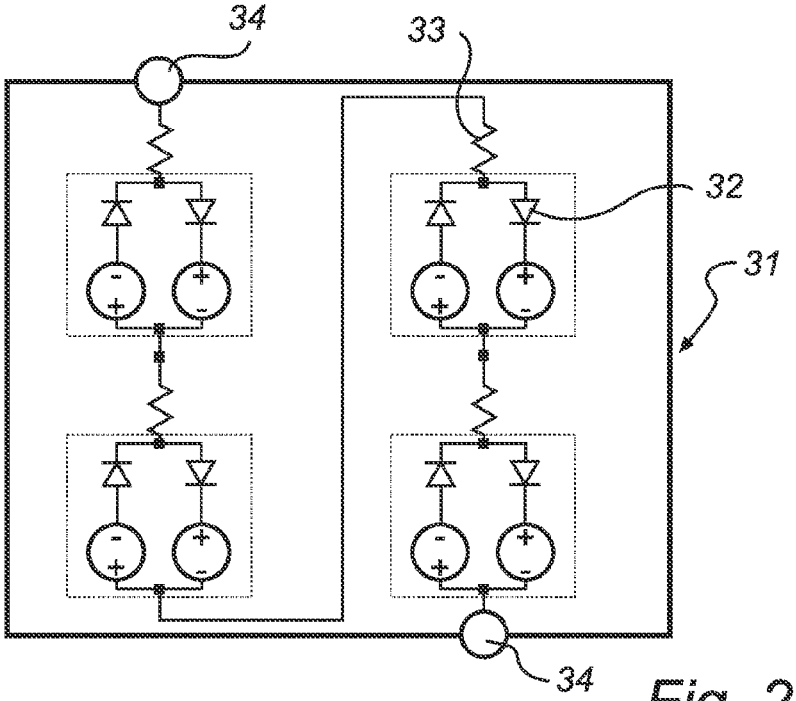
FIG. 2 shows a more detailed circuit diagram of a LED circuit in the circuit arrangement in FIG. 1.

It should be noted that, compared with a conventional ACLED, as shown in FIG. 2, only two additional terminals 48*a*, 48*b* are required, connected by wires 49*a*, 49*b* to their respective connection points.

The phase-shifting elements, here the capacitors, and/or resistors may be controllable. Such controllability may for example comprise changing the physical properties, such as a size, a distance, etc. of the capacitor/resistor and/or may comprise a dedicated control input and/or may comprise several capacitors/resistors of different size and selection means, e.g. a second capacitor, which can be connected in parallel or in series to the first capacitor/resistor by means of one or more controllable switches and/or may comprise applying a control voltage across the capacitor/resistor by means of a suitable decoupling network to advantageously adjust the capacitive current phase angles, e.g. to optimize the power factor of complete systems of lamps. The controllability of the capacitors/resistors can be used e.g. during production of the devices (e.g. laser trimming of the capacitor/resistor size) or during production of luminaries consisting of one or more devices or during operation to achieve a desired operating point.

Alternatively, or in combination, the LED circuits may be controllable. Such controllability may for example comprise adjusting the wiring of the light emitting diode circuit by means of laser trimming etc.

A person skilled in the art realizes that the present invention is by no means limited to the preferred embodiments described above. On the contrary, many modifications and variations are possible within the scope of the appended claims. For example, the LED circuits may be modified, and must not be based on the circuit in FIG. 2. Also, additional components may be included in the circuit arrangement, such as additional resistors, capacitors and/or inductors.

One or more pieces of the device may be monolithically integrated on one or more pieces of semi-conductive material or another kind of material, different numbers of junctions may be present in one package or in different packages, and many other different embodiments and implementations are not to be excluded. One or more pieces of the device 1 may be integrated with one or more other pieces of the device 1. One or more pieces of the device 1 may comprise one or more parasitic elements and/or may be based on a presence of these one or more parasitic elements. The AC voltage may be 110 volts, 220 volts, 12 volts or any other kind of AC voltage. Furthermore, the invention is not limited to emission of white light, but the color of the light emitted by the LEDs can be chosen according to the application.

The invention claimed is:

1. A circuit arrangement for a light emitting device, comprising:

a first circuit branch for receiving an AC voltage and comprising a first light emitting diode (LED) circuit serially connected with a first phase-shifting element, a second circuit branch connected in parallel with said first circuit branch, said second circuit branch comprising a second LED circuit serially connected to a second phase-shifting element, in reverse order compared to the LED circuit and phase-shifting element in the first circuit branch, and a third circuit branch comprising a third LED circuit, said third circuit branch having one end connected to a point in said first circuit branch between said first LED circuit and said first phase-shifting element, and a second end connected to a point in said second circuit branch between said second LED circuit and said second phase-shifting element.

2. The circuit arrangement as claimed in claim 1, wherein at least one of said phase-shifting elements is formed by a capacitor.

3. The circuit arrangement as claimed in claim 1, wherein the respective first, second and third circuit branches comprise respective first, second and third resistors coupled serially to or forming part of the respective first, second and third LED circuits.

4. The circuit arrangement as claimed in claim 1, wherein at least one of the first and second phase-shifting elements is controllable.

5. The circuit arrangement as claimed in claim 1, wherein at least one of the first and second LED circuits is controllable.

6. The circuit arrangement as claimed in claim 3, wherein at least one of the first and second resistors is controllable.

7. The circuit arrangement as claimed in claim 1, wherein at least one of the light emitting diode circuits being capable of generating light in response to at least a part of a positive half of the AC voltage as well as in response to at least a part of a negative half of the AC voltage.

8. The circuit arrangement as claimed in claim 7, wherein at least one of the light emitting diode circuits comprises two anti-parallel strings of one or more light emitting diodes.

9. The circuit arrangement as claimed in claim 7, wherein at least one of the light emitting diode circuits comprises a rectifier coupled to a string of one or more light emitting diodes.

10. An AC voltage illumination device comprising a light source including at least one circuit arrangement according to any one of the preceding claims.

* * * * *